United States Patent [19]

Janouin et al.

[11] Patent Number: 4,995,065

[45] Date of Patent: Feb. 19, 1991

[54] X-RAY TUBE COOLING DEVICES

[75] Inventors: Serge Janouin, Issy Les Moulineaux; Philippe Masse, Morsang/Orge; Bernard Pouzergues, Villemoisson/Roge, all of France

[73] Assignee: General Electric CGR S.A., Issy les Molineaux, France

[21] Appl. No.: 416,298

[22] Filed: Oct. 3, 1989

[30] Foreign Application Priority Data

Oct. 7, 1988 [FR] France ..... 88 13195

[51] Int. Cl.[5] ..... H01J 35/10

[52] U.S. Cl. ..... 378/130; 378/141; 378/199; 378/200; 378/202; 378/142

[58] Field of Search ..... 378/141, 199, 200, 202, 378/130, 142

[56] References Cited

U.S. PATENT DOCUMENTS 3,959,685 5/1976 Konieczynski ..... 313/330
4,300,622 11/1981 Lindner ..... 165/1
4,383,576 5/1983 Bricard et al. ..... 165/104.17
4,678,961 7/1987 Comberg et al. ..... 313/36
4,780,901 10/1988 Gabbay et al. ..... 378/141

FOREIGN PATENT DOCUMENTS 0196699 10/1986 European Pat. Off. .
0268516 5/1988 European Pat. Off. .
1527813 10/1978 United Kingdom .

OTHER PUBLICATIONS

Handbook of Chemistry and Physics, 61st Edition, (1980–81), p. F-24.

*Primary Examiner*—Edward P. Westin
*Assistant Examiner*—Don Wong
*Attorney, Agent, or Firm*—Walter C. Farley

[57] ABSTRACT

The disclosure concerns X-ray tubes. To obtain greater temperature stability of an X-ray tube, a substance is placed in the circulation space of the cooling fluid of the tube. The latent heat of fusion of this substance is used so that it melts during the examination stage in absorbing heat, and gets solidified during the resting stage. The disclosure is applicable to X-ray tubes.

9 Claims, 1 Drawing Sheet

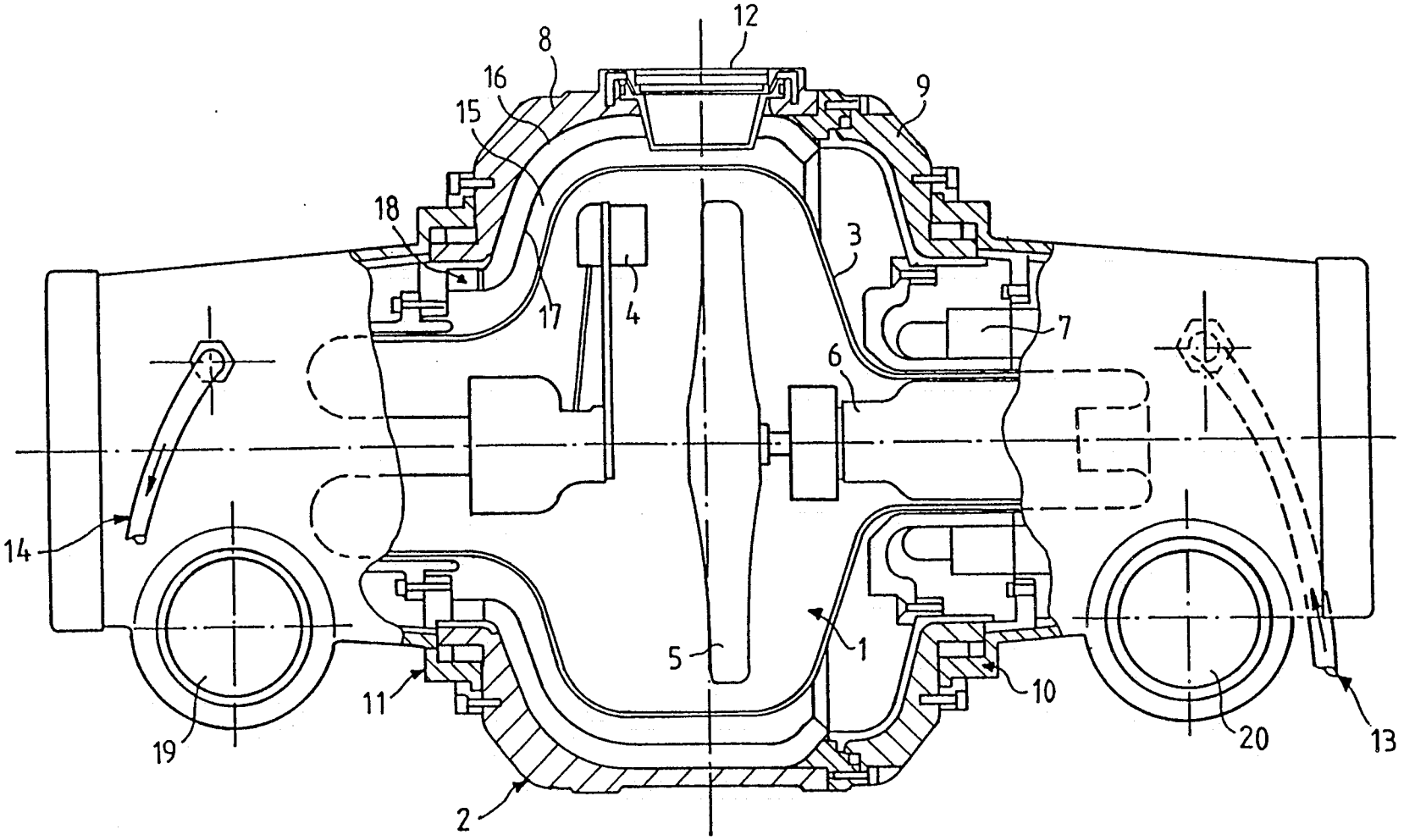
13
20
7
10
9
3
6
1
12
5
4
8
17
16
15
2
18
11
19
14

X-RAY TUBE COOLING DEVICES

BACKGROUND OF THE INVENTION

1. Field of the Invention

The invention concerns X-ray tube cooling devices.

2. Description of the Prior Art

X-ray tubes, for medical diagnosis for example, are generally formed by a diode, namely, with a cathode and an anode or an anti-cathode, these two electrodes being enclosed in a vacuum sealed casing enabling the setting up of electrical insulation between these two electrodes. The cathode produces a beam of electrons and the anode receives these electrons on a small area which forms a focal spot from which the X-rays are emitted.

When the high supply voltage is applied to the terminals of the cathode and the anode so that the cathode is at the negative potential, a so-called anode current is set up in the circuit through a generator producing the high supply voltage. The anodic current crosses the space between the cathode and the anode in the form of an electron beam which bombards the focal spot.

A small portion of the energy used to produce the electron beam is converted into X-rays, while the rest of this energy is converted into heat. Thus, also taking into account the high instantaneous power values involved (of the order of 100 KW) and the small dimensions of the focal spot (of the order of 1 millimeter), manufacturers have long been making rotating-anode X-ray tubes where the anode is made to rotate to distribute the thermal flux on a crown or ring, called a focal ring, which has a far greater area than the focal spot, the interest of this approach being all the greater as the rotational speed is high (generally between 3,000 and 12,000 rpm).

The standard type of rotating anode has the general shape of a disk with an axis of symmetry around which it is made to rotate by means of an electrical motor. The electrical motor has a stator located outside the casing and a rotor which is mounted in the casing of the X-ray tube and arranged along the axis of symmetry, the rotor being mechanically joined to the anode by means of a supporting shaft.

The energy dissipated in a tube of this type is high and, therefore, provision is made to cool it. To this end, the tube is enclosed in a chamber in which a cooling fluid, notably oil, is made to flow. The fluid is itself cooled in an exchanger which may be of the air or water type. Thus, a cooling device has been made that works permanently. However, the X-ray tube emits only intermittently so that the dissipated energy is high during the examination phase itself, which lasts from a few seconds to a few minutes, and is practically null during the resting time needed for changing patients. The result is major disparities in the quantity of heat to be removed depending on the phase considered. This leads notably to major variations in the temperatures of the tube materials used. These variations may harm the operation of the tube. Thus, the variations in the tube fixing part cause shifts in the focal spot. The cooling chamber or sheath may also undergo major variations in temperature. This is harmful to the environment especially when there are electronic devices nearby. To prevent a great increase in temperature during the examination period, it has been proposed to increase the refrigeration capacity of the cooling device, but this leads to the oversizing of the latter, which is incompatible with the available space.

Furthermore, during the resting stage, a major drop in temperature is obtained. This drop is all the greater as this stage is long, with the above-mentioned drawbacks relating to major variations in temperature.

To overcome this latter aspect, it has been proposed to regulate the operating time of the cooling device as a function of the temperature of the cooling fluid. A regulation of this kind, which appears to be easy to implement in theory, is difficult to achieve in practice for technical and technological reasons which shall not be explained herein.

SUMMARY OF THE INVENTION

An object of the present invention, therefore, is to make a cooling device which does not have the above-mentioned drawbacks in incorporating, in the cooling chamber or sheath, one or more bodies which will melt during the examination stage in absorbing heat and which will get solidified during the resting stage.

The invention pertains to an improvement in an X-ray tube cooling device, said device having a sheath that surrounds the X-ray tube and defines a space for the flow of the cooling fluid in communication with a cooler, a device wherein there is positioned, in the sheath, a substance, the latent heat of fusion of which is used in the circulation space so that said substance or heat storage medium melts in absorbing heat during the operating stage of the X-ray tube, and gets solidified during the resting stage of said tube.

There are many substances with latent heat of fusion that can be used. Preferably, those substances are used that have a high latent heat of fusion and a melting temperature compatible with the average temperature of the cooling liquid when said substance is not present.

The substance with latent heat of fusion is enclosed in a casing which is bonded to the inner wall of the sheath and is designed to enable an expansion of the substance.

Preferably, only one part of the casing is designed to be expansible. This is achieved by using, for this part, for example synthetic rubber or a stainless steel blower bellows which can change shape.

The substance with latent heat of fusion may be a mixture having elements with high atomic number so as to form a shield to X-rays.

BRIEF DESCRIPTION OF THE DRAWING

Other features and advantages of the present invention will appear from the following description of a particular exemplary embodiment, said description being made with reference to the single drawing which represents a partial sectional view of an X-ray tube placed in its cooling sheath, said sheath being made according to the invention.

DESCRIPTION OF A PREFERRED EMBODIMENT

This single figure shows an X-ray tube 1 placed in a cooling sheath 2. The X-ray tube 1 has a glass casing 3 in which a high vacuum is made. Inside this casing 3, there is an emitting cathode 4 and an anode 5 which, in this particular example, is rotational. The anode 5 is mounted at the end of a rotor 6, which works together with a stator 7 placed outside the casing 3.

The cooling sheath 2 is, for example, formed by the tightly sealed assembly of four parts marked 8, 9, 10 and II. The part II, which is substantially central, carries the X-radiation outlet window 12. The extreme parts 10 and 11 are closed at their ends and one of them has an inlet hole 13 for the cooling liquid, while the other has an outlet hole 14 for this liquid. The parts 8 and 10 are connected by means of the part 9.

The cooling fluid flows in the defined space 15 between the casing 3 and the inner walls of the sheath 2 and is, therefore, in contact with the glass casing 3 so as to cool it.

The electrical supply cables of the X-ray tube penetrate the sheath 2 through the hole 19 for the cathode 4 and the hole 20 for the anode 5.

According to the invention, the cooling of the tube is improved, notably as regards stability under temperature, through the installation, in the circulation space 15, of a substance 16, the latent heat of fusion of which is used. This substance 16 also called heat storage medium, is contained in a casing 17 so as to prevent its being mixed with the cooling fluid.

In the figure, this substance is fixed to the inner wall of the central part 8 by the bonding of its casing 17 to said wall.

Of course, other substances can be placed in the parts 9, 10 and 11, so as to increase their total volume and thus improve their overall efficiency. Besides, other fastening supports as well as other fixing means can be used without going beyond the scope of the present invention.

The substance 16 should be chosen in such a way that it has a latent heat of fusion which is as high as possible, and so that its melting temperature is close to the mean temperature that the cooling fluid would have in the absence of the substance 16. Thus, during the stage in which the tube is used, the dissipated power makes the substance !6 melt and it absorbs heat. By contrast, during the resting stage, it cools down and gets solidified, and these two phenomenae of melting or solidification occur at a defined temperature that remains constant throughout their duration. The result thereof is great stability in the temperature of the unit.

The substances with latent heat of fusion that can be used are many. However, it is necessary to take into account the ease with which they can be used in the field of X-ray tubes. In particular, it is necessary to avoid choosing substances with latent heat of fusion that are corrosive with respect to the immediate environment, such as the metal of which the sheath is made, or the more distant environment, for example the presence of human beings or electronic devices.

Good results have been obtained with the following substances : paraffins (tests with melting temperatures of 54° C. to 58° C.), mixtures of wax paraffins (melting temperatures of 60° C. to 105° C.), mixtures of waxes, mixtures of waxes and paraffins, methyl fumarate, Wood's metal etc.

Since the solid phase has a specific volume different from that of the liquid phase, which is smaller in most cases (greater for water), the casing 17 of the substance must be designed to enable an increase in the volume of the substance. It is the role of the part 18 which forms the expansion volume. This volume consists of an annular bellows inserted in the metallic casing 17 and placed at one end of it or at any other position on said casing. This bellows can be made of materials such as stainless steel (of the corrugated piping type), synthetic rubber, etc.

According to the present invention, the substance 16 with latent heat of fusion may include elements with a high atomic number such as bismuth, lead, etc. so as to form a shield against X-rays emitted in directions other than the outlet window 12. This enables a reduction in the thickness of the sheath 2 at the central part 8 and thus makes it possible to keep the weight of the set at an acceptable value despite the increase in the weight due to the substance 16.

It must be noted that the substance 16 cannot be placed anywhere in the circulation space. Notably, placing it on the casing 3 of the tube 1 is not recommended, because this part should be quickly cooled. This implies contact with the cooling fluid.

The following are the main advantages provided by the invention:

an increase in cooling power, all other things being equal besides;

the cooling power is adapted to a power value close to the mean daily power value (examination stages plus resting stages) whereas, in prior art devices, it is suited to the mean power value of the examination stage. This makes it possible, in particular, to reduce the size of the cooler;

greater temperature stability of the sheath;

its implementation requires no substantial increase in the dimensions of the sheath 2.

What is claimed is:

1. An improved X-ray tube cooling apparatus for cooling an X-ray tube surrounded by a sheath, the sheath and tube defining a space for the flow of a cooling fluid in communication with a cooler, the apparatus comprising the combination of a casing in said space in heat exchange relationship with the cooling fluid, and a substance in said casing selected to have a latent heat of fusion which melts and absorbs heat during X-ray generating operation of said tube and solidifies during periods between generation of X-rays.

2. An apparatus according to claim 1 wherein said substance comprises a paraffin or a mixture of paraffins.

3. An apparatus according to claim 1 wherein said substance comprises a wax or a mixture of waxes.

4. An apparatus according to claim 1 wherein said substance comprises methyl fumarate.

5. An apparatus according to claim 1 wherein said substance comprises Wood's metal.

6. An apparatus according to claim 1 wherein said casing includes means for permitting expansion.

7. An apparatus according to claim 6 wherein said means for permitting expansion comprises a bellows.

8. An apparatus according to claim 1 wherein said casing is bonded to an internal wall of the sheath.

9. An apparatus according to claim 1 wherein said substance consists of a mixture comprising an element with a high atomic number so that said substance forms a barrier to X-rays.

* * * * *